US011578571B2

(12) United States Patent
Alghamdi

(10) Patent No.: US 11,578,571 B2
(45) Date of Patent: Feb. 14, 2023

(54) DOWNHOLE ELECTRIC SWITCH

(71) Applicant: Saudi Arabian Oil Company, Dhahran (SA)

(72) Inventor: Anwar Salah S. Alghamdi, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 45 days.

(21) Appl. No.: 17/181,596

(22) Filed: Feb. 22, 2021

(65) Prior Publication Data

US 2022/0268131 A1 Aug. 25, 2022

(51) Int. Cl.

| | |
|---|---|
| ***E21B 43/12*** | (2006.01) |
| ***E21B 17/02*** | (2006.01) |
| ***E21B 41/00*** | (2006.01) |
| ***E21B 33/038*** | (2006.01) |

(52) U.S. Cl.

CPC ..... *E21B 43/128* (2013.01); *E21B 17/028* (2013.01); *E21B 33/0385* (2013.01); *E21B 41/00* (2013.01)

(58) Field of Classification Search

CPC .. E21B 43/128; E21B 17/028; E21B 33/0385; E21B 41/00

See application file for complete search history.

(56) References Cited

U.S. PATENT DOCUMENTS

| | | | | |
|---|---|---|---|---|
| 4,523,194 | A | 6/1985 | Hyde | |
| 8,353,352 | B2 | 1/2013 | Leitch | |
| 2009/0183870 | A1* | 7/2009 | Leitch | E21B 43/128 166/244.1 |
| 2015/0037171 | A1* | 2/2015 | Orrego | E21B 43/128 417/423.3 |
| 2015/0047836 | A1* | 2/2015 | Mitchell | E21B 47/092 166/64 |
| 2018/0347313 | A1* | 12/2018 | Joseph | E21B 34/066 |
| 2021/0246771 | A1* | 8/2021 | Ejim | E21B 43/128 |

* cited by examiner

*Primary Examiner* — Brad Harcourt

(74) *Attorney, Agent, or Firm* — Fish & Richardson P.C.

(57) ABSTRACT

Systems and methods include a system for controlling a downhole multi-circuit switch using a downhole actuator mechanism. A command is sent, by a surface controller coupled to downhole electrically-powered equipment in a wellbore of a well, to change electrical power flow in a multi-circuit switch to a specified position of multiple positions. A connection between the surface controller and the downhole electrically-powered equipment includes at least two separate input electrical connections for supplying electrical power to the downhole electrically-powered equipment. The command is received by a downhole actuator mechanism from the surface controller. The command indicates to switch from a first electrical connection of the at least two separate input electrical connections to a second electrical connection of the at least two separate input electrical connections. The multi-circuit switch is switched by the downhole actuator mechanism based on the command to change a power source of the downhole electrically-powered equipment, including isolating a first input electrical connection.

19 Claims, 4 Drawing Sheets

DOWNHOLE ELECTRIC SWITCH

TECHNICAL FIELD

The present disclosure applies to powering downhole equipment for a well.

BACKGROUND

Drilling operations, for example in oil or gas wells, may use electrically-powered downhole equipment, such as electric submersible pumps (ESPs) that are powered through power cables from a power source on the surface. Shorts in a power cable can cause the electrically-powered downhole equipment to stop working. Conventional techniques may require rig intervention to service the electrically-powered downhole equipment that has failed due to a primary electric transmission system failure.

SUMMARY

The present disclosure describes techniques that can be used for powering downhole equipment for a well. In some implementations, a computer-implemented method includes the following. A command is sent, by a surface controller coupled to downhole electrically-powered equipment in a wellbore of a well, to change electrical power flow in a multi-circuit switch to a specified position of multiple positions. A connection between the surface controller and the downhole electrically-powered equipment includes at least two separate input electrical connections for supplying electrical power to the downhole electrically-powered equipment. The command is received by a downhole actuator mechanism from the surface controller. The command indicates to switch from a first electrical connection of the at least two separate input electrical connections to a second electrical connection of the at least two separate input electrical connections. The multi-circuit switch is switched by the downhole actuator mechanism based on the command to change a power source of the downhole electrically-powered equipment, including isolating a first input electrical connection.

The previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method, the instructions stored on the non-transitory, computer-readable medium.

The subject matter described in this specification can be implemented in particular implementations, so as to realize one or more of the following advantages. Multiple power cables can be installed for a single electrically-powered piece of downhole equipment. The circuit can be changed from one to another in case one of the cables burns out. This redundancy can result in avoiding the need to pull out electrically-powered downhole equipment, an action that may require rig intervention. This solves the problem of failed power transmission to electrically-powered downhole equipment. The techniques of the present disclosure provide an improvement over conventional systems by increasing the number of input electric transmission systems connected to a switch and providing a spare that can be used in case any of the components of the primary electric transmission system fails. This solves the problem of electrical burns that can result in delay costs, shutdown costs, and rig costs. Solutions can be accomplished by having spare transmission systems that can be switched to, and used immediately, without having to pull out electrically-powered downhole equipment. This solves the problem in conventional systems that may aim to decrease the number of electric cables connected to a downhole equipment, as the techniques of the present disclosure increase the number of electric cables to act as spare transmission systems. Some conventional systems may use dual (or more than 2) pieces of electrically-powered downhole equipment in a single wellbore. However, the present disclosure focuses on typically single pieces of electrically-powered downhole equipment, although multiple pieces of equipment can exist.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DESCRIPTION OF DRAWINGS

Like reference numbers and designations in the various drawings indicate like elements.

DETAILED DESCRIPTION

The following detailed description describes techniques for providing redundancy in circuits for downhole electric switches. For example, the techniques can be used for downhole equipment to provide electrical power to a single piece of electrically-powered downhole equipment using multiple power cables. Electrical power can be alternated by a multi-circuit switch equipped with a switch mechanism to shift between cables in case any of the components of the primary electric transmission system fails. This technology can be used for any electrically-powered downhole equipment, such as a permanent downhole monitoring system (PDHMS), an electric submersible pump (ESP), and a downhole electric heater. This can eliminate failure modes pertaining to downhole power transmission systems.

Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

In some implementations, a downhole multi-circuit switch is designed to be connected to any downhole electrically-powered equipment. The bottom of the switch (output) is connected directly to the downhole equipment, and the top of the switch (input) is connected to two or more power cables coming from the surface. The multi-circuit switch includes a hydraulic switch mechanism controllable from the surface used to change the switch position, which changes the path of the electrical circuit from one power cable to another. The proposed switch allows two or more cables to be connected to one electrically-powered downhole system to alternate between them in case any of the components of the primary electric transmission system fails.

Figure 1:
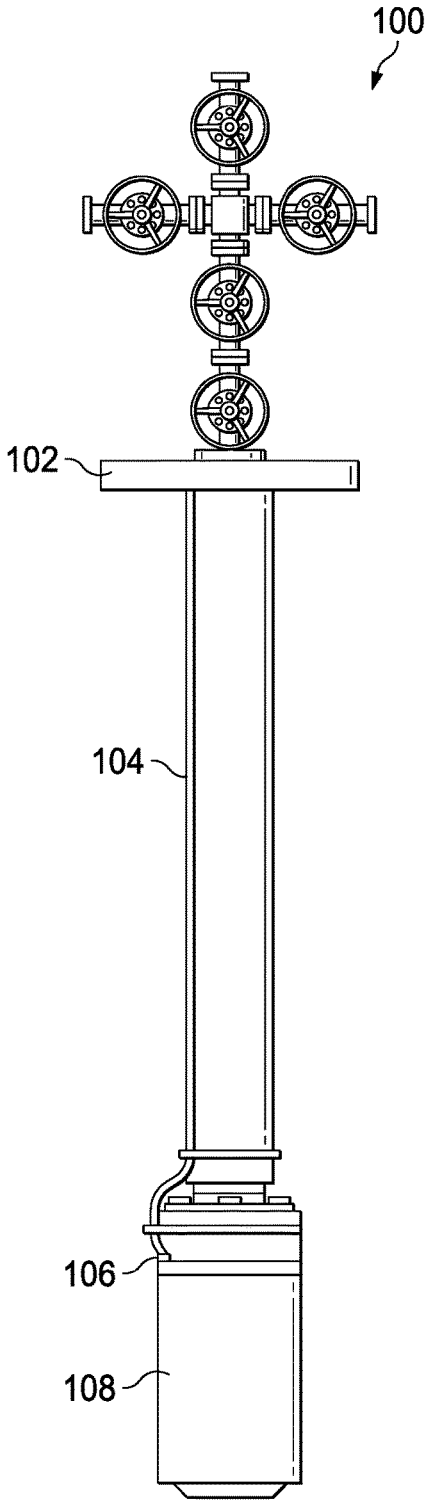
FIG. 1 is a schematic view showing an example configuration of a typical piece of downhole electrically-powered equipment as part of a production string, according to some implementations of the present disclosure.

FIG. 1 is a schematic view showing an example configuration of a typical piece of downhole electrically-powered equipment 100 as part of a production string, according to some implementations of the present disclosure. The equipment 100 is part of a typical conventional system, for example. The equipment 100 includes a wellhead penetrator 102, a power cable 104, a power input 106, and electrically-powered equipment 108 (for example, an electric submersible pump). In this example, the power cable 104 is a single cable, a condition for which the present disclosure provides an improvement. The equipment 100 includes a controller configured to perform operations, such as to switch between power inputs for reasons described in the present disclosure.

Figure 2:
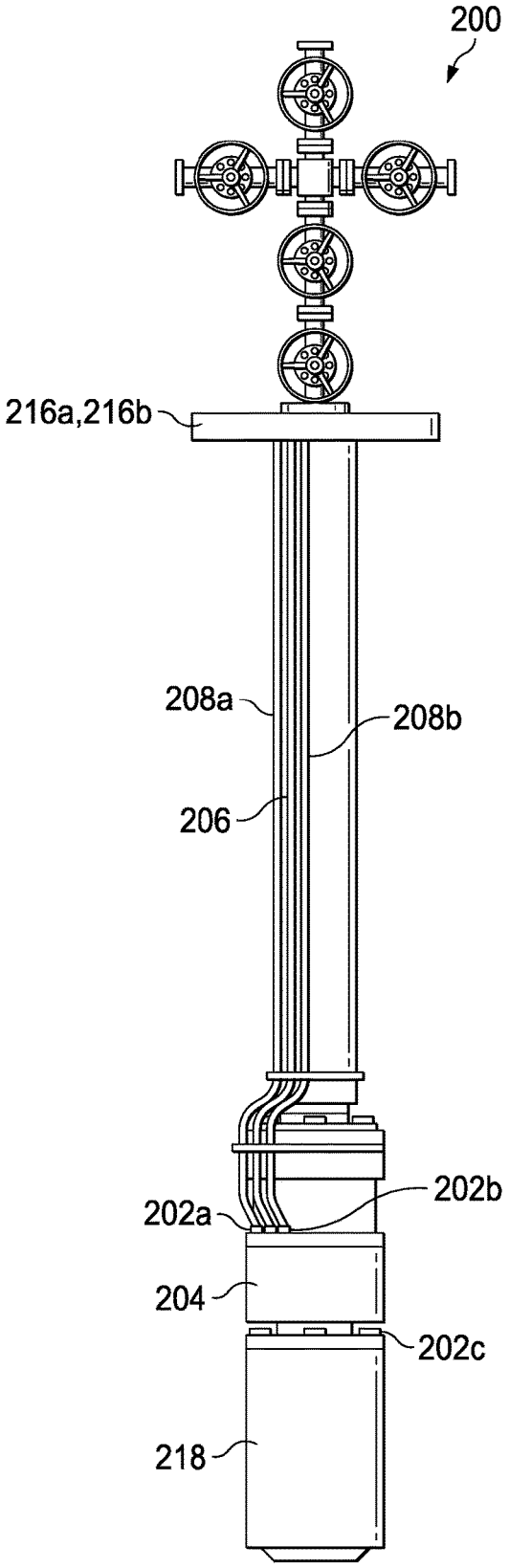
FIG. 2 is a schematic view showing an example piece of downhole electrically-powered equipment with two power cables, according to some implementations of the present disclosure.

FIG. 2 is a schematic view showing an example piece of downhole electrically-powered equipment 200 with two power cables, according to some implementations of the present disclosure. The configuration of the downhole electrically-powered equipment 200 provides an improvement over the downhole electrically-powered equipment 100 because of the use of the two power cables.

The downhole electrically-powered equipment 200 provides a downhole multi-circuit switch equipped with a switch mechanism for inclusion in or above any downhole electrically-powered equipment. In some implementations, the downhole multi-circuit switch can be a computer-implemented switch. The downhole multi-circuit switch includes at least two power inputs 202*a* and 202*b* for electrical power, and an output 202*c* for electrical power. The downhole electrically-powered equipment 200 can include a controller that is implemented as one or more processors and a computer-readable medium (CRM).

A multi-circuit switch 204 is configured to select an input electrical connection, and to cut and isolate the unselected input electrical connections. For example, the multi-circuit switch 204 can select the input connection 202*b* and disconnect the input connection 202*a*.

Figure 3A:
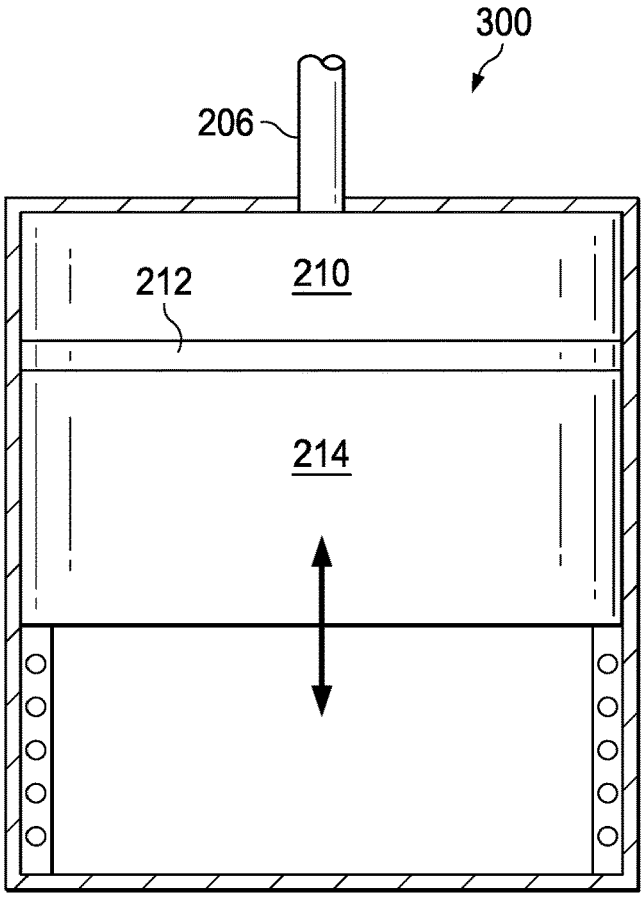
FIG. 3A is a schematic view of a downhole multi-circuit switch with a hydraulic switch mechanism, according to some implementations of the present disclosure.

FIG. 3A is a schematic view of a downhole multi-circuit switch 300 with a hydraulic switch mechanism, according to some implementations of the present disclosure. For example, the downhole multi-circuit switch can be used with the downhole electrically-powered equipment 200.

Figure 3B:
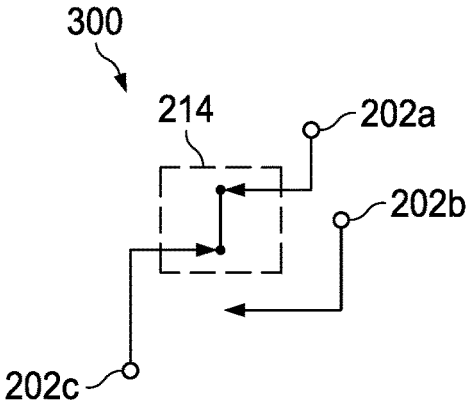
FIG. 3B is a schematic view of the downhole multi-circuit switch shown in FIG. 3A at a first position, according to some implementations of the present disclosure.

FIG. 3B is a schematic view of the downhole multi-circuit switch shown in FIG. 3A at a first position, according to some implementations of the present disclosure. For example, position 1 connects first power cable 208*a* at input 202*a* to the output power connection 202*c*.

Figure 3C:
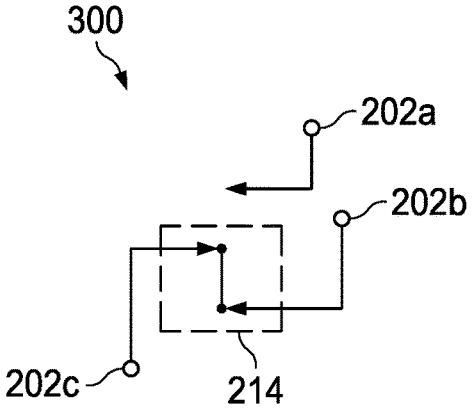
FIG. 3C is a schematic view of the downhole multi-circuit switch shown in FIG. 3A at a second position, according to some implementations of the present disclosure.

FIG. 3C is a schematic view of the downhole multi-circuit switch shown in FIG. 3A at a second position, according to some implementations of the present disclosure. For example, position 2 connects second power cable 208*b* at input 202*b* to the output power connection 202*c*.

An actuator mechanism is capable of being actuated from the surface to selectively switch between at least two positions shown in FIGS. 3B and 3C to provide a selective electrical circuit connection between one of the input connections 202*a* and 202*b* and the output connection 202*c*. The output point 202*c* of the multi-circuit switch 204 transmits power to the downhole electrically-powered equipment 218. In some implementations, software and interfaces for communicating between actuator mechanisms and a controller at the surface can include portable or fixed surface control panels used to control downhole hydraulic switches, for example, by injecting hydraulic fluid(s). Modifications can be applied on the actuator to achieve objectives of the present disclosure. For example, the hydraulic actuator can be implemented in other ways to control switching.

In some implementations, the actuator mechanism includes a switch arm mechanism moveable between multiple positions (FIG. 3B and FIG. 3C) and capable of being actuated from the surface, where each position is associated with one of the electrical power inputs (202*a* and 202*b*). In some implementations, the switch arm 214 in the actuator is powered from the surface using a hydraulic system. For example, the hydraulic system can include a piston cylinder 210 and piston 212 arrangement. A fluid can be injected through a hydraulic line 206 to move a switch arm with a heavy duty return spring 214, and mechanically control the switch position from the surface.

The hydraulic line 206 can be purged before use and connected directly to the piston chamber 210. Alternatively, a hydraulic fluid can be delivered from the surface through the hydraulic line 206 and injected into (or withdrawn from) the piston cylinder 210. This can move the piston 212 and the position of the switch arm 214 to select and connect the first power cable 208*a* at position 1 (FIG. 3B), or the second power cable 208*b* at position 2 (FIG. 3C).

The switch arm 214 at the first position shown in FIG. 3B connects the first power cable 208*a* from the input electrical connection 202*a* to the output power connection 202*c* through the multi-circuit switch 204. The switch arm 214 at the second position shown in FIG. 3C connects the second power cable 208*b* from the input electrical connection 202*b* to the output power connection 202*c* through the multi-circuit switch 204.

The multi-circuit switch 204 can be located at any downhole location and can be connected to any electrically-powered device through one or more electric power inputs and one or more power outputs. The multi-circuit switch 204 can be a separate external part that connects multiple power cables at the input to one or more power cables at the output to supply power to one or more pieces of electrically-powered equipment underground.

The systems described with reference to FIGS. 2-3C can be used to provide a multi-circuit switch 204 equipped with a switch mechanism. The multi-circuit switch 204 can be supplied with electrical power from the surface by multiple electrical cables 208*a* and 208*b*. The cables can penetrate the wellhead through separate wellhead penetrators. The cables can be coupled to a single downhole electrically-powered equipment 218 through a single output power connection 202*c*.

The systems described with reference to FIGS. 2-3C can be actuated from the surface. The switch mechanism can be configured within the multi-circuit switch 204 to move between multiple positions (FIG. 3B and FIG. 3C). Each of the positions can be associated with one of the input electrical connections (202*a* and 202*b*) and cables (208*a* and 208*b*) respectively. In this way, electrical power can be selectively supplied from one of the multiple electrical cables to the single downhole electrically-powered equipment 218 through the output power connection 202*c*.

Figure 4:
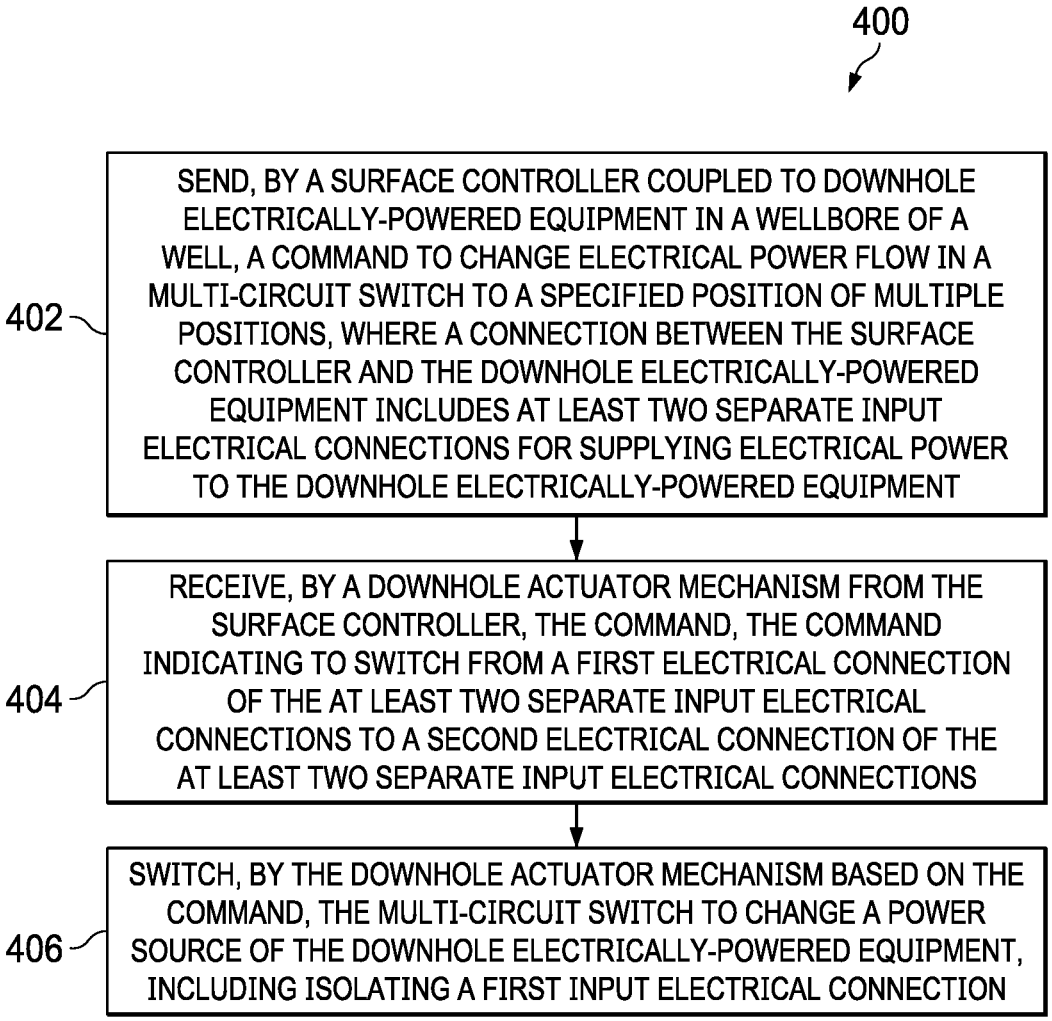
FIG. 4 is a flowchart of an example of a method for powering a single piece of downhole electrically-powered equipment using multiple electrical cables, according to some implementations of the present disclosure.

FIG. 4 is a flowchart of an example of a method 400 for powering a single piece of downhole electrically-powered equipment using multiple electrical cables, according to some implementations of the present disclosure. For clarity of presentation, the description that follows generally describes method 400 in the context of the other figures in this description. However, it will be understood that method 400 can be performed, for example, by any suitable system, environment, software, and hardware, or a combination of systems, environments, software, and hardware, as appropriate. In some implementations, various steps of method 400 can be run in parallel, in combination, in loops, or in any order.

At 402, a command is sent, by a surface controller coupled to downhole electrically-powered equipment in a wellbore of a well, to change electrical power flow in a multi-circuit switch to a specified position of multiple positions. A connection between the surface controller and the downhole electrically-powered equipment includes at least two separate input electrical connections for supplying electrical power to the downhole electrically-powered equipment. For example, a downhole multi-circuit switch can be configured to be coupled to downhole electrically-powered equipment below a surface and configured to control a source of electrical power to the downhole electrically-powered equipment. The downhole multi-circuit switch can include at least two input connections for supplying electrical power to the downhole electrically-powered equipment, an output connection for the electrical power, a switch configured to isolate an unselected input electrical connection, an actuator mechanism configured to control the switch, and an output point of the switch to transmit the electrical power through the output connection to the downhole electrically-powered equipment. The downhole multi-circuit switch can be below the surface and can be included in or above the downhole electrically-powered equipment. The actuator mechanism can be actuated from the surface controller to selectively switch between the positions, causing the switch to provide a selective electrical circuit connection between one of the at least two input connections and the output connection. The at least two input connections can include multiple electrical cables penetrating a wellhead of a well. The multiple electrical cables can penetrate the wellhead using separate wellhead penetrators. The switch can include a switch arm mechanism moveable between multiple positions. The switch can include a hydraulic switch mechanism for moving between multiple positions. From 402, method 400 proceeds to 404.

At 404, the command is received by a downhole actuator mechanism from the surface controller. The command indicates to switch from a first electrical connection of the at least two separate input electrical connections to a second electrical connection of the at least two separate input electrical connections, for example, as shown in FIGS. 3A-3C. From 404, method 400 proceeds to 406.

At 406, the multi-circuit switch is switched by the downhole actuator mechanism based on the command to change a power source of the downhole electrically-powered equipment, including isolating a first input electrical connection. A controller can be configured to perform operations including receiving, by the actuator mechanism from a surface controller on the surface, a command to switch the switch between positions, and switching, by the switch, the electrical power from the unselected input electrical connection to the input electrical connection. After 406, method 400 can stop.

Figure 5:
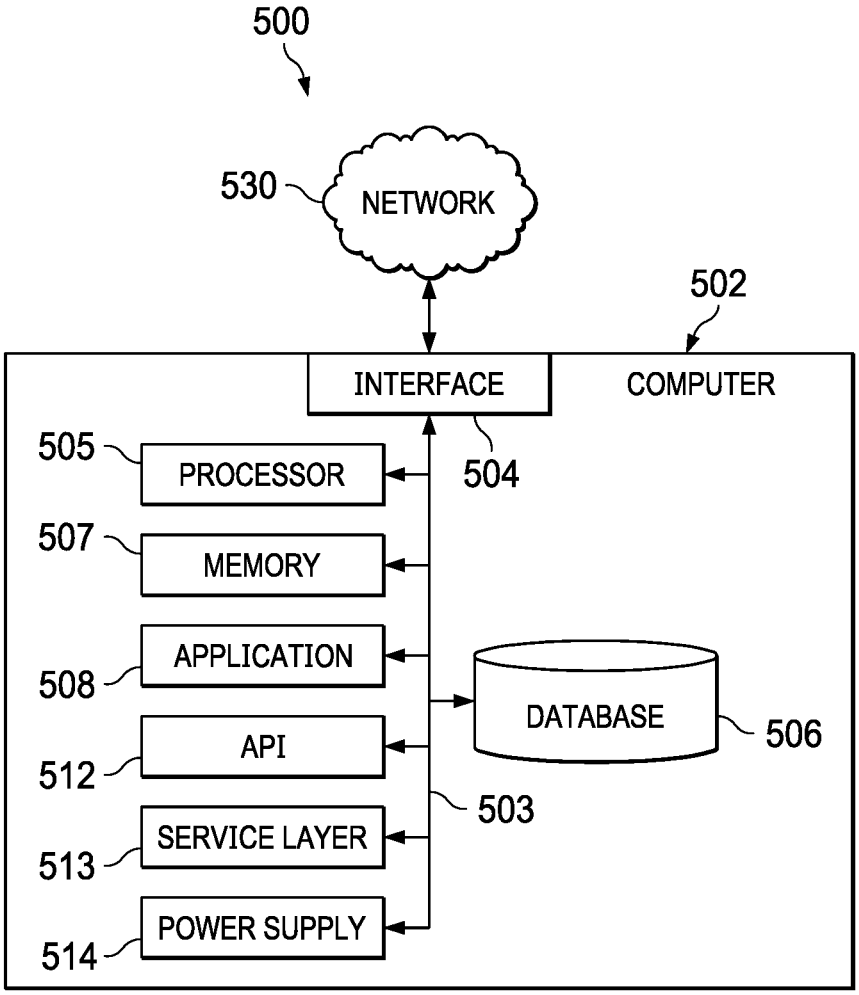
FIG. 5 is a block diagram illustrating an example computer system used to provide computational functionalities associated with described algorithms, methods, functions, processes, flows, and procedures as described in the present disclosure, according to some implementations of the present disclosure.

FIG. 5 is a block diagram of an example computer system 500 used to provide computational functionalities associated with described algorithms, methods, functions, processes, flows, and procedures described in the present disclosure, according to some implementations of the present disclosure. The illustrated computer 502 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 502 can include input devices such as keypads, keyboards, and touch screens that can accept user information. Also, the computer 502 can include output devices that can convey information associated with the operation of the computer 502. The information can include digital data, visual data, audio information, or a combination of information. The information can be presented in a graphical user interface (UI) (or GUI).

The computer 502 can serve in a role as a client, a network component, a server, a database, a persistency, or components of a computer system for performing the subject matter described in the present disclosure. The illustrated computer 502 is communicably coupled with a network 530. In some implementations, one or more components of the computer 502 can be configured to operate within different environments, including cloud-computing-based environments, local environments, global environments, and combinations of environments.

At a top level, the computer 502 is an electronic computing device operable to receive, transmit, process, store, and manage data and information associated with the described subject matter. According to some implementations, the computer 502 can also include, or be communicably coupled with, an application server, an email server, a web server, a caching server, a streaming data server, or a combination of servers.

The computer 502 can receive requests over network 530 from a client application (for example, executing on another computer 502). The computer 502 can respond to the received requests by processing the received requests using software applications. Requests can also be sent to the computer 502 from internal users (for example, from a command console), external (or third) parties, automated applications, entities, individuals, systems, and computers.

Each of the components of the computer 502 can communicate using a system bus 503. In some implementations, any or all of the components of the computer 502, including hardware or software components, can interface with each other or the interface 504 (or a combination of both) over the system bus 503. Interfaces can use an application programming interface (API) 512, a service layer 513, or a combination of the API 512 and service layer 513. The API 512 can include specifications for routines, data structures, and object classes. The API 512 can be either computer-language independent or dependent. The API 512 can refer to a complete interface, a single function, or a set of APIs.

The service layer 513 can provide software services to the computer 502 and other components (whether illustrated or not) that are communicably coupled to the computer 502. The functionality of the computer 502 can be accessible for all service consumers using this service layer. Software services, such as those provided by the service layer 513, can provide reusable, defined functionalities through a defined interface. For example, the interface can be software written in JAVA, C++, or a language providing data in extensible markup language (XML) format. While illustrated as an integrated component of the computer 502, in alternative implementations, the API 512 or the service layer 513 can be stand-alone components in relation to other components of the computer 502 and other components communicably coupled to the computer 502. Moreover, any or all parts of the API 512 or the service layer 513 can be implemented as child or sub-modules of another software module, enterprise application, or hardware module without departing from the scope of the present disclosure.

The computer 502 includes an interface 504. Although illustrated as a single interface 504 in FIG. 5, two or more interfaces 504 can be used according to particular needs, desires, or particular implementations of the computer 502 and the described functionality. The interface 504 can be used by the computer 502 for communicating with other systems that are connected to the network 530 (whether illustrated or not) in a distributed environment. Generally, the interface 504 can include, or be implemented using, logic encoded in software or hardware (or a combination of software and hardware) operable to communicate with the network 530. More specifically, the interface 504 can include software supporting one or more communication protocols associated with communications. As such, the network 530 or the interface's hardware can be operable to communicate physical signals within and outside of the illustrated computer 502.

The computer 502 includes a processor 505. Although illustrated as a single processor 505 in FIG. 5, two or more processors 505 can be used according to particular needs, desires, or particular implementations of the computer 502 and the described functionality. Generally, the processor 505 can execute instructions and can manipulate data to perform the operations of the computer 502, including operations using algorithms, methods, functions, processes, flows, and procedures as described in the present disclosure.

The computer 502 also includes a database 506 that can hold data for the computer 502 and other components connected to the network 530 (whether illustrated or not). For example, database 506 can be an in-memory, conventional, or a database storing data consistent with the present disclosure. In some implementations, database 506 can be a combination of two or more different database types (for example, hybrid in-memory and conventional databases) according to particular needs, desires, or particular implementations of the computer 502 and the described functionality. Although illustrated as a single database 506 in FIG. 5, two or more databases (of the same, different, or combination of types) can be used according to particular needs, desires, or particular implementations of the computer 502 and the described functionality. While database 506 is illustrated as an internal component of the computer 502, in alternative implementations, database 506 can be external to the computer 502.

The computer 502 also includes a memory 507 that can hold data for the computer 502 or a combination of components connected to the network 530 (whether illustrated or not). Memory 507 can store any data consistent with the present disclosure. In some implementations, memory 507 can be a combination of two or more different types of memory (for example, a combination of semiconductor and magnetic storage) according to particular needs, desires, or particular implementations of the computer 502 and the described functionality. Although illustrated as a single memory 507 in FIG. 5, two or more memories 507 (of the same, different, or combination of types) can be used according to particular needs, desires, or particular implementations of the computer 502 and the described functionality. While memory 507 is illustrated as an internal component of the computer 502, in alternative implementations, memory 507 can be external to the computer 502.

The application 508 can be an algorithmic software engine providing functionality according to particular needs, desires, or particular implementations of the computer 502 and the described functionality. For example, application 508 can serve as one or more components, modules, or applications. Further, although illustrated as a single application 508, the application 508 can be implemented as multiple applications 508 on the computer 502. In addition, although illustrated as internal to the computer 502, in alternative implementations, the application 508 can be external to the computer 502.

The computer 502 can also include a power supply 514. The power supply 514 can include a rechargeable or non-rechargeable battery that can be configured to be either user- or non-user-replaceable. In some implementations, the power supply 514 can include power-conversion and management circuits, including recharging, standby, and power management functionalities. In some implementations, the power-supply 514 can include a power plug to allow the computer 502 to be plugged into a wall socket or a power source to, for example, power the computer 502 or recharge a rechargeable battery.

There can be any number of computers 502 associated with, or external to, a computer system containing computer 502, with each computer 502 communicating over network 530. Further, the terms "client," "user," and other appropriate terminology can be used interchangeably, as appropriate, without departing from the scope of the present disclosure. Moreover, the present disclosure contemplates that many users can use one computer 502 and one user can use multiple computers 502.

Described implementations of the subject matter can include one or more features, alone or in combination.

For example, in a first implementation, a computer-implemented method includes the following. A command is sent by a surface controller coupled to downhole electrically-powered equipment in a wellbore of a well. The command is a command to change electrical power flow in a downhole multi-circuit switch to a specified position of multiple positions. A connection between the surface controller and the downhole electrically-powered equipment includes at least two separate input electrical connections for supplying electrical power to the downhole electrically-powered equipment. The command is received by a downhole actuator mechanism from the surface controller. The command indicates to switch from a first electrical connection of the at least two separate input electrical connections to a second electrical connection of the at least two separate input electrical connections. The downhole multi-circuit switch is switched by the downhole actuator mechanism based on the command to change a power source of the downhole electrically-powered equipment, including isolating a first input electrical connection.

The foregoing and other described implementations can each, optionally, include one or more of the following features:

A first feature, combinable with any of the following features, the method further including: determining, through a signal received by the surface controller from the downhole electrically-powered equipment, that the first electrical connection has failed; and sending, based on the determining, the command to change electrical power flow in the downhole multi-circuit switch to the specified position of multiple positions.

A second feature, combinable with any of the previous or following features, where the downhole multi-circuit switch is below the surface and is included in or above the downhole electrically-powered equipment.

A third feature, combinable with any of the previous or following features, where the downhole actuator mechanism: i) is actuated from the surface controller to selectively switch between the positions, and ii) causes the switch to provide a selective electrical circuit connection between one of the at least two input connections and the output connection.

A fourth feature, combinable with any of the previous or following features, where the at least two input connections include multiple electrical cables penetrating a wellhead of a well.

A fifth feature, combinable with any of the previous or following features, where the multiple electrical cables penetrate the wellhead using separate wellhead penetrators.

A sixth feature, combinable with any of the previous or following features, where the switch includes a switch arm mechanism moveable between multiple positions.

A seventh feature, combinable with any of the previous or following features, the switch includes a hydraulic switch mechanism for moving between multiple positions.

In a second implementation, a non-transitory, computer-readable medium stores one or more instructions executable by a computer system to perform operations including the following. A command is sent, by a surface controller coupled to downhole electrically-powered equipment in a wellbore of a well, to change electrical power flow in a multi-circuit switch to a specified position of multiple positions. A connection between the surface controller and the downhole electrically-powered equipment includes at least two separate input electrical connections for supplying electrical power to the downhole electrically-powered equipment. The command is received by a downhole actuator mechanism from the surface controller. The command indicates to switch from a first electrical connection of the at least two separate input electrical connections to a second electrical connection of the at least two separate input electrical connections. The multi-circuit switch is switched by the downhole actuator mechanism based on the command to change a power source of the downhole electrically-powered equipment, including isolating a first input electrical connection.

The foregoing and other described implementations can each, optionally, include one or more of the following features:

A first feature, combinable with any of the following features, the operations further including: determining, through a signal received by the surface controller from the downhole electrically-powered equipment, that the first electrical connection has failed; and sending, based on the determining, the command to change electrical power flow in the downhole multi-circuit switch to the specified position of multiple positions.

A second feature, combinable with any of the previous or following features, where the downhole multi-circuit switch is below the surface and is included in or above the downhole electrically-powered equipment.

A third feature, combinable with any of the previous or following features, where the downhole actuator mechanism: i) is actuated from the surface controller to selectively switch between the positions, and ii) causes the switch to provide a selective electrical circuit connection between one of the at least two input connections and the output connection.

A fourth feature, combinable with any of the previous or following features, where the at least two input connections include multiple electrical cables penetrating a wellhead of a well.

In a third implementation, a system includes the following. A downhole multi-circuit switch is configured to be coupled to downhole electrically-powered equipment below a surface and configured to control a source of electrical power to the downhole electrically-powered equipment. The downhole multi-circuit switch includes: at least two input connections for supplying electrical power to the downhole electrically-powered equipment; an output connection for the electrical power; a switch configured to isolate an unselected input electrical connection; an actuator mechanism configured to control the switch; and an output point of the switch to transmit the electrical power through the output connection to the downhole electrically-powered equipment. A controller is configured to perform operations including: receiving, by the actuator mechanism from a surface controller on the surface, a command to switch the switch between positions; and switching, by the switch, the electrical power from the unselected input electrical connection to the input electrical connection.

The foregoing and other described implementations can each, optionally, include one or more of the following features:

A first feature, combinable with any of the following features, where the downhole multi-circuit switch is below the surface and is included in or above the downhole electrically-powered equipment.

A second feature, combinable with any of the following features, where the actuator mechanism: i) is actuated from the surface controller to selectively switch between the positions, and ii) causes the switch to provide a selective electrical circuit connection between one of the at least two input connections and the output connection.

A third feature, combinable with any of the following features, where the at least two input connections include multiple electrical cables penetrating a wellhead of a well.

A fourth feature, combinable with any of the following features, where the multiple electrical cables penetrate the wellhead using separate wellhead penetrators.

A fifth feature, combinable with any of the following features, where the switch includes a switch arm mechanism moveable between multiple positions.

A sixth feature, combinable with any of the following features, where the switch includes a hydraulic switch mechanism for moving between multiple positions.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory.

Graphics processing units (GPUs) can also be used in combination with CPUs. The GPUs can provide specialized processing that occurs in parallel to processing performed by CPUs. The specialized processing can include artificial intelligence (AI) applications and processing, for example. GPUs can be used in GPU clusters or in multi-GPU computing.

A computer can include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch-screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A system, comprising:

a downhole multi-circuit switch configured to be coupled to downhole electrically-powered equipment below a surface and configured to control a source of electrical power to the downhole electrically-powered equipment, the downhole multi-circuit switch comprising:

at least two input connections for supplying electrical power to the downhole electrically-powered equipment, wherein the at least two input connections include multiple electrical cables penetrating a wellhead of a well;

an output connection for the electrical power;

a switch configured to isolate an unselected input electrical connection;

an actuator mechanism configured to control the switch; and an output point of the switch to transmit the electrical power through the output connection to the downhole electrically-powered equipment; and a controller configured to perform operations comprising:

receiving, by the actuator mechanism from a surface controller on the surface, a command to switch to switch between positions; and switching, by the switch, the electrical power from the unselected input electrical connection to the input electrical connection.

2. The system of claim 1, wherein the downhole multi-circuit switch is below the surface and is included in or above the downhole electrically-powered equipment.

3. The system of claim 1, wherein the actuator mechanism: i) is actuated from the surface controller to selectively switch between the positions, and ii) causes the switch to provide a selective electrical circuit connection between one of the at least two input connections and the output connection.

4. The system of claim 1, wherein the multiple electrical cables penetrate the wellhead using separate wellhead penetrators.

5. The system of claim 1, wherein the switch includes a switch arm mechanism moveable between multiple positions.

6. The system of claim 1, wherein the switch includes a hydraulic switch mechanism for moving between multiple positions.

7. A computer-implemented method, comprising:

sending, by a surface controller coupled to downhole electrically-powered equipment in a wellbore of a well, a command to change electrical power flow in a downhole multi-circuit switch to a specified position of multiple positions, wherein a connection between the surface controller and the downhole electrically-powered equipment includes at least two separate input electrical connections for supplying electrical power to the downhole electrically-powered equipment;

receiving, by a downhole actuator mechanism from the surface controller, the command, the command indicating to switch from a first electrical connection of the at least two separate input electrical connections to a second electrical connection of the at least two separate input electrical connections; and switching, by the downhole actuator mechanism based on the command, the downhole multi-circuit switch to change a power source of the downhole electrically-powered equipment, including isolating a first input electrical connection.

8. The computer-implemented method of claim 7, further comprising:

determining, through a signal received by the surface controller from the downhole electrically-powered equipment, that the first electrical connection has failed; and sending, based on the determining, the command to change electrical power flow in the downhole multi-circuit switch to the specified position of multiple positions.

9. The computer-implemented method of claim 7, wherein the downhole multi-circuit switch is below the surface and is included in or above the downhole electrically-powered equipment.

10. The computer-implemented method of claim 7, wherein the downhole actuator mechanism: i) is actuated from the surface controller to selectively switch between the positions, and ii) causes the switch to provide a selective electrical circuit connection between one of the at least two input connections and the output connection.

11. The computer-implemented method of claim 7, wherein the at least two input connections include multiple electrical cables penetrating a wellhead of the well.

12. The computer-implemented method of claim 11, wherein the multiple electrical cables penetrate the wellhead using separate wellhead penetrators.

13. The computer-implemented method of claim 7, wherein the switch includes a switch arm mechanism moveable between multiple positions.

14. The computer-implemented method of claim 7, wherein the switch includes a hydraulic switch mechanism for moving between multiple positions.

15. A non-transitory, computer-readable medium storing one or more instructions executable by a computer system to perform operations comprising:

sending, by a surface controller coupled to downhole electrically-powered equipment in a wellbore of a well, a command to change electrical power flow in a downhole multi-circuit switch to a specified position of multiple positions, wherein a connection between the surface controller and the downhole electrically-powered equipment includes at least two separate input electrical connections for supplying electrical power to the downhole electrically-powered equipment;

receiving, by a downhole actuator mechanism from the surface controller, the command, the command indicating to switch from a first electrical connection of the at least two separate input electrical connections to a second electrical connection of the at least two separate input electrical connections; and switching, by the downhole actuator mechanism based on the command, the downhole multi-circuit switch to change a power source of the downhole electrically-powered equipment, including isolating a first input electrical connection.

16. The non-transitory, computer-readable medium of claim 15, the operations further comprising:

determining, through a signal received by the surface controller from the downhole electrically-powered equipment, that the first electrical connection has failed; and sending, based on the determining, the command to change electrical power flow in the downhole multi-circuit switch to the specified position of multiple positions.

17. The non-transitory, computer-readable medium of claim 15, wherein the downhole multi-circuit switch is below the surface and is included in or above the downhole electrically-powered equipment.

18. The non-transitory, computer-readable medium of claim 15, wherein the downhole actuator mechanism: i) is actuated from the surface controller to selectively switch between the positions, and ii) causes the switch to provide a selective electrical circuit connection between one of the at least two input connections and the output connection.

19. The non-transitory, computer-readable medium of claim 15, wherein the at least two input connections include multiple electrical cables penetrating a wellhead of the well.

* * * * *